US010768650B1

(12) United States Patent
Huang

(10) Patent No.: US 10,768,650 B1
(45) Date of Patent: Sep. 8, 2020

(54) VOLTAGE REGULATOR WITH CAPACITANCE MULTIPLIER

(71) Applicant: Dialog Semiconductor (UK) Limited, London (GB)

(72) Inventor: Chi-Chia Huang, Hsinchu (TW)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 16/183,887

(22) Filed: Nov. 8, 2018

(51) Int. Cl.
*G05F 1/575* (2006.01)
*G05F 1/46* (2006.01)

(52) U.S. Cl.
CPC ..... *G05F 1/575* (2013.01); *G05F 1/46* (2013.01)

(58) Field of Classification Search
CPC . G05F 1/575; G05F 1/56; G05F 3/262; G05F 1/10; G05F 1/46; G05F 1/461; G05F 1/467; G05F 1/462; G05F 1/561; G05F 3/02; G05F 3/242; G05F 3/222
See application file for complete search history.

(56) References Cited

U.S. PATENT DOCUMENTS 5,563,501 A * 10/1996 Chan ..... G05F 1/565 323/273
5,734,293 A * 3/1998 Gross ..... G01J 1/44 323/316
6,084,475 A * 7/2000 Rincon-Mora ..... H03F 1/086 327/112
6,300,749 B1 * 10/2001 Castelli ..... G05F 1/575 323/273
8,912,772 B2 12/2014 Childs
9,256,233 B2 * 2/2016 Mandal ..... G05F 1/575
2010/0289568 A1 * 11/2010 Eschauzier ..... H03F 3/45475 330/9
2011/0156674 A1 * 6/2011 Lin ..... G05F 1/575 323/282
2017/0003699 A1 * 1/2017 Lin ..... G05F 1/575
2017/0264190 A1 * 9/2017 Unno ..... H02M 3/04
2018/0342948 A1 * 11/2018 Lin ..... H02M 3/07

OTHER PUBLICATIONS

"Robust Miller Compensation With current Amplifiers Applied to LDO Voltage Regulators," by Gianluca Guistolisi et al., IEEE Transactions on Circuits and Systems, I: Regular Papers, vol. 59, No. 9, Sep. 2012, pp. 1880-1893.
"Full On-Chip CMOS Low-Dropout Voltage Regulator," by Robert J. Milliken et al., IEEE Transactions on Circuits and Systems—I: Regular Papers, vol. 54, No. 9, Sep. 2007, pp. 1879-1890.
"Active Capacitor Multiplier in Miller-Compensated Circuits," by Gabriel A. Rincon-Mora, IEEE Transactions on Solid-State Circuits, vol. 35, No. 1, Jan. 2000, pp. 26-32.

* cited by examiner

*Primary Examiner* — Gustavo A Rosario-Benitez
(74) *Attorney, Agent, or Firm* — Saile Ackerman LLC; Stephen B. Ackerman

(57) ABSTRACT

A voltage regulator and a method for regulating an output voltage are presented. The voltage regulator includes a frequency compensation circuit having a first capacitor coupled to a capacitance multiplier. The capacitance multiplier has a second capacitor coupled to a voltage amplifier. The voltage amplifier amplifies a first voltage that is a function of the output voltage. The advantage of this regulator and method is that it allows increasing the total capacitance of the frequency compensation circuit without unduly increasing the size of the regulator. Another advantage is the allowance of changing the amplification factor without affecting the DC gain.

14 Claims, 11 Drawing Sheets

VOLTAGE REGULATOR WITH CAPACITANCE MULTIPLIER

TECHNICAL FIELD

The present disclosure relates to voltage regulator. In particular the present disclosure relates to a voltage regulator provided with a capacitance multiplier.

BACKGROUND

Linear regulators and in particular low drop out linear voltage regulators (LDOs) can be used to provide a regulated voltage. As such, linear regulators are important building blocks of many power management systems.

Within its operating range, a linear regulator provides a constant output DC voltage regardless of the input voltage or load current. This is achieved by sensing the output voltage and regulating a current source. The output voltage is regulated using a feedback loop which is stabilised using a compensation circuit. After a change in load current, the linear regulator requires a certain amount of time, also referred to as transient response time, to return to steady state conditions. Existing LDO circuits which implement a frequency compensation technique, require the use of a large compensation capacitor. This increases the size of the circuit and slows down the transient response of the regulator.

Compensations techniques based on current amplifiers have also been proposed. In this scenario a compensation capacitor is amplified through a current amplifier integrated into the regulation loop. However, these circuits have a limited multiplication factor and suffer from instability.

SUMMARY

It is an object of the disclosure to address one or more of the above-mentioned limitations. According to a first aspect of the disclosure, there is provided a voltage regulator for regulating an output voltage, the voltage regulator comprising a frequency compensation circuit having a first capacitor coupled to a capacitance multiplier; wherein the capacitance multiplier comprises a second capacitor coupled to a voltage amplifier; wherein the voltage amplifier is configured to amplify a first voltage that is function of the output voltage.

For example, the voltage amplifier may have a gain greater than one.

Optionally, the output voltage has a low frequency component and a high frequency component, and wherein the first voltage corresponds to the high frequency component.

The first voltage may be a direct value of the high frequency component or a representation of high frequency component such as a divided or multiplied version of the high frequency component. For example, the high frequency component may be an AC component of the output voltage associated with variations or ripples in the output voltage.

Optionally, the first capacitor and the capacitance multiplier are coupled in parallel.

Optionally, the voltage amplifier comprises a voltage-to-current converter coupled to a current-to-voltage converter.

Optionally, the voltage to current converter is adapted to provide a current based on a difference between a feedback voltage and a reference voltage.

For example, the feedback voltage may be proportional to the output voltage. For instance, the feedback voltage may be equal to the output voltage, or it may be a representation of the output voltage such as a divided version of the output voltage.

Optionally, the voltage regulator comprises a switch element having a control terminal for receiving a control signal, and first and second path terminals located at a first and second end of a conductive path respectively; the switch element being adapted to selectively couple a voltage supply at the first end with an output of the regulator at the second end.

Optionally, the voltage to current converter is coupled to the second path terminal.

Optionally, the voltage regulator comprises a potential divider coupled to the second path terminal, wherein the voltage to current converter is coupled to an output of the potential divider.

Optionally, the voltage regulator comprises an input stage coupled to a controller for providing the control signal; wherein the capacitance multiplier is coupled to an output of the input stage.

Optionally, the voltage regulator comprises a reference voltage source coupled to the input stage and to the voltage to current converter.

Optionally, the second capacitor comprises a metal-insulator-metal capacitor and a metal-oxide semiconductor capacitor.

Optionally, the current to voltage converter is adapted to provide a voltage comprising a DC component. For example, the DC component may be a positive component that is function of a gate to source voltage of the second capacitor.

Optionally, the current to voltage converter comprises a constant current source coupled to a resistance via a current mirror. For instance, the resistance has a terminal adapted to receive an output of the voltage to current converter. The output of the voltage to current converter may be a difference current.

Optionally, the voltage regulator is a linear regulator. For example, the voltage regulator may be a low drop out regulator.

According to a second aspect of the description, there is provided a method of regulating a voltage comprising the step of providing a voltage regulator for regulating an output voltage; wherein the voltage regulator comprises a frequency compensation circuit having a first capacitor coupled to a capacitance multiplier; the capacitance multiplier comprising a second capacitor coupled to a voltage amplifier; and amplifying a first voltage that is function of the output voltage.

Optionally, the output voltage has a low frequency component and a high frequency component, and wherein the first voltage corresponds to the high frequency component.

Optionally, the voltage amplifier comprises a voltage-to-current converter coupled to a current-to-voltage converter.

The options described with respect to the first aspect of the disclosure are also common to the second aspect of the disclosure.

BRIEF DESCRIPTION OF THE DRAWINGS

The disclosure is described in further detail below by way of example and with reference to the accompanying drawings, in which.

DESCRIPTION

Figure 1:
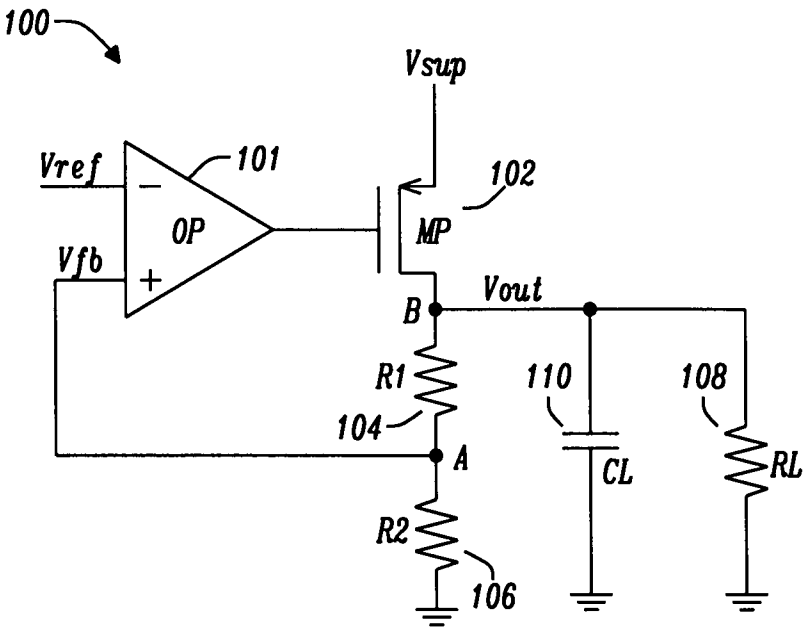
FIG. 1 Prior Art
FIG. 1 is a conventional linear voltage regulator.

FIG. 1 illustrates a conventional low drop-out regulator LDO. The LDO includes a differential amplifier or op-amp 101 that is coupled to a pass transistor 102 and a potential divider formed by resistance R1 104 and R2 106. The differential amplifier 101 has an inverting input coupled to a reference voltage Vref and a non-inverting input coupled to the potential divider at node A between the resistance R1 and R2. The output of the differential amplifier 101 is coupled to the gate terminal of the pass transistor 102. The pass transistor 102 has a source terminal coupled to a voltage supply providing a supply voltage Vsup, while its the drain terminal is coupled to the potential divider at node B. A load resistance RL 108 and an output capacitor CL 110 are coupled in parallel with the potential divider at node B.

The frequency response of such a circuit can be analysed by deriving its transfer function and finding the roots of the transfer function also referred to as poles and zeros. Stated another way, the poles and zeros correspond to the frequencies for which the value of the denominator and numerator of the transfer function become zero respectively.

In operation, the differential amplifier 101, also referred to as error amplifier controls the pass transistor 102 in order to regulate the output voltage Vout. The LDO provides a constant output DC voltage, however in practise small output voltage fluctuations, also referred to as ripples may occur due to fluctuations in the input voltage or load current.

The resistance RL 108 in parallel with the resistors R1 104, R2 106 and the channel resistance of the pass transistor 102 form an equivalent resistance $R_{EQ}$. The output capacitor CL and the resistance $R_{EQ}$ at the output node B contribute to form a pole P1. In a light load condition, the pole P1 is at a very low frequency, for instance 1 Hz. However, in a heavy load condition when RL is small, the pole P1 moves to a high frequency, for instance 1 KHz. Therefore, an internal compensation circuit also referred to as frequency compensation circuit is required to provide another low frequency pole.

Figure 2:
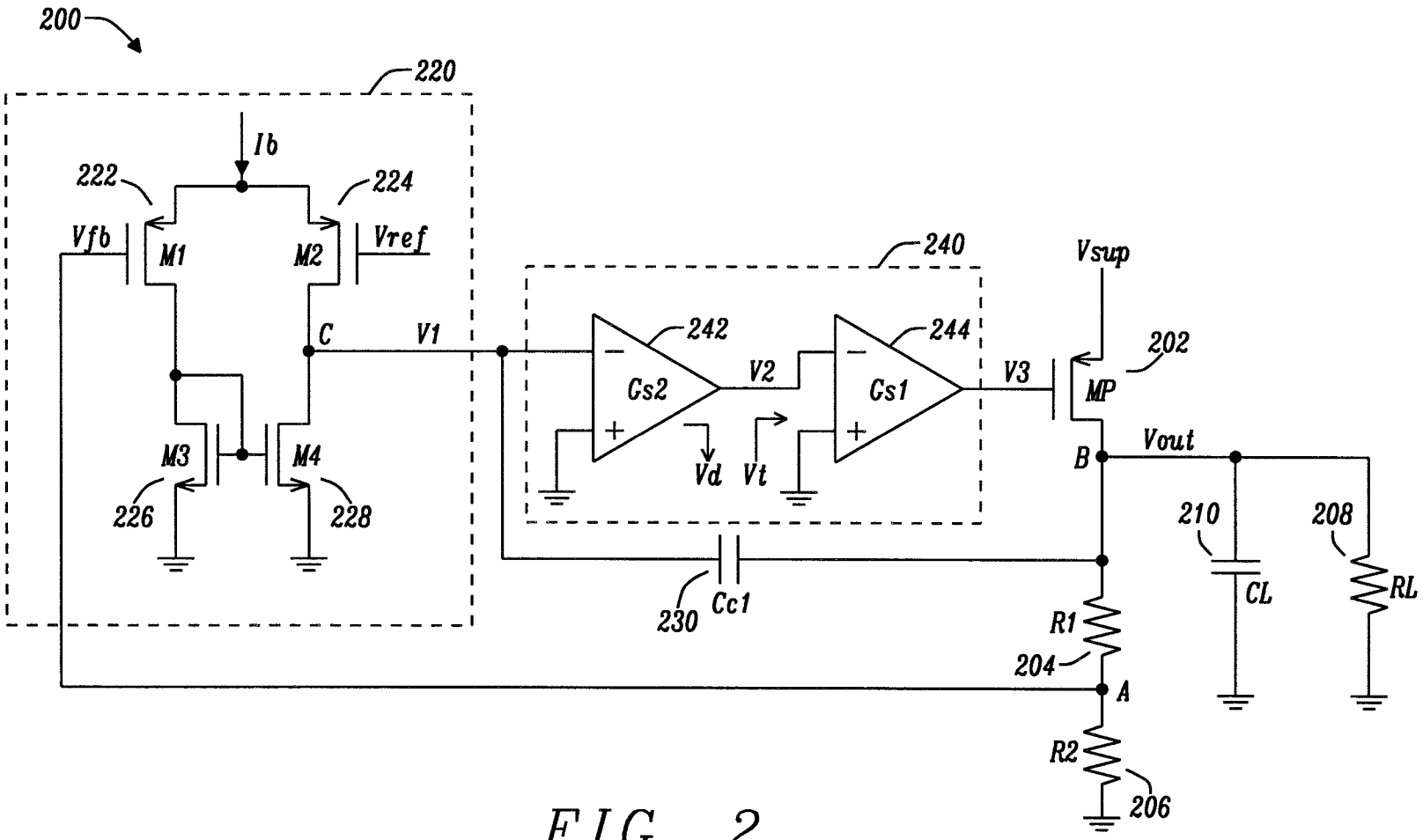
FIG. 2 is a linear voltage regulator provided with a compensation circuit.

FIG. 2 illustrates a linear voltage regulator 200 provided with such a compensation circuit. The circuit of FIG. 2 is an extension of the circuit described in FIG. 1 in which references 202, 204, 206, 208 and 210 correspond to the features 102, 104, 106, 108 and 110 respectively. The circuit 200 includes an input stage 220 coupled to a controller 240 formed by a pair of differential amplifiers 242 and 244 for providing a control signal to the pass transistor 202. The frequency compensation circuit is formed by compensation capacitor Cc1 230 provided between the output of the regulator at node B and the input of the controller 240 at node C.

The input stage 220 includes a first transistor M1 222, a second transistor M2 224 and a current mirror formed by transistors M3 226 and M4 228. The transistor M3 has a drain terminal connected to the drain terminal of transistor M1 222. The transistor M4 228 has a drain terminal connected to the drain terminal of transistor M2 224 at node C. The transistor M1 222 has a gate terminal coupled to the potential divider at node A, for receiving a feedback voltage Vfb, while the transistor M2 224 has a gate terminal for receiving a reference voltage Vref. The source terminal of M1 222 is coupled to the source terminal of M2 224 for receiving a current Ib. The source terminal of M3 226 and M4 228 are both coupled to ground. The drain terminal of M1 is coupled to the gate terminal of M3 and M4.

The output of the input stage 220 is coupled to the controller 240 at node C.

The differential amplifier 242 has an inverting input coupled to node C; a non-inverting input coupled to ground and an output coupled to the inverting input of the differential amplifier 244. The output of the differential amplifier 244 is coupled to the gate terminal of the pass transistor 202. The compensation capacitor Cc1 230 has a first terminal coupled to the inverting input of differential amplifier 242 at node C, and a second terminal coupled to the drain of the pass transistor 202 at node B.

In operation, the input stage 220 amplifies the feedback voltage Vfb to a value V1 provided at the input of the controller 240. The differential amplifiers 242 and 244 provide a control signal V3 at the gate terminal of the pass transistor 202. The compensation capacitor CC1 is used to perform so-called pole splitting by introducing a low frequency pole at node C.

The circuit 200 has three poles, and one zero: a first pole P1 at the output node B, a second pole P2 at node C, a third pole P3 at the output of the second differential amplifier 244 and a zero Z1. Two paths exit between the nodes B and C, a first path via Cc1, and a second path via the input stage 220. The first path has a wide bandwidth but no DC gain, while the second path has a narrow bandwidth with high DC gain. The combination of the first and second paths gives rise to the zero Z1.

The P1, P2, P3 and Z1 frequencies may be expressed as follows:

$$P_1 = \frac{1}{2\pi R_{EQ} C_L} \tag{1}$$

In which $R_{EQ}$ is the equivalent resistance corresponding to the parallel combination of R1+R2 and the channel resistance of the pass transistor MP 202.

$$P_2 = \frac{1}{2\pi C_{C1} R_{024}} \tag{2}$$

In which $R_{024}$ is the resistance corresponding to the parallel combination of the channel resistance of the transistors M2 224 and M4 228.

$$P_3 = \frac{1}{2\pi C_{mp} R_{0gs1}} \tag{3}$$

In which Cmp is the capacitance of the pass transistor 202 between its gate terminal and ground, and $R_{0gs1}$ is the output resistance of the differential amplifier 244.

$$Z_1 = \frac{Gm1}{2\pi C_{C1}} \quad (4)$$

In which Gm1 is the small-signal transconductance of transistors M1 and M2.

Figure 3:
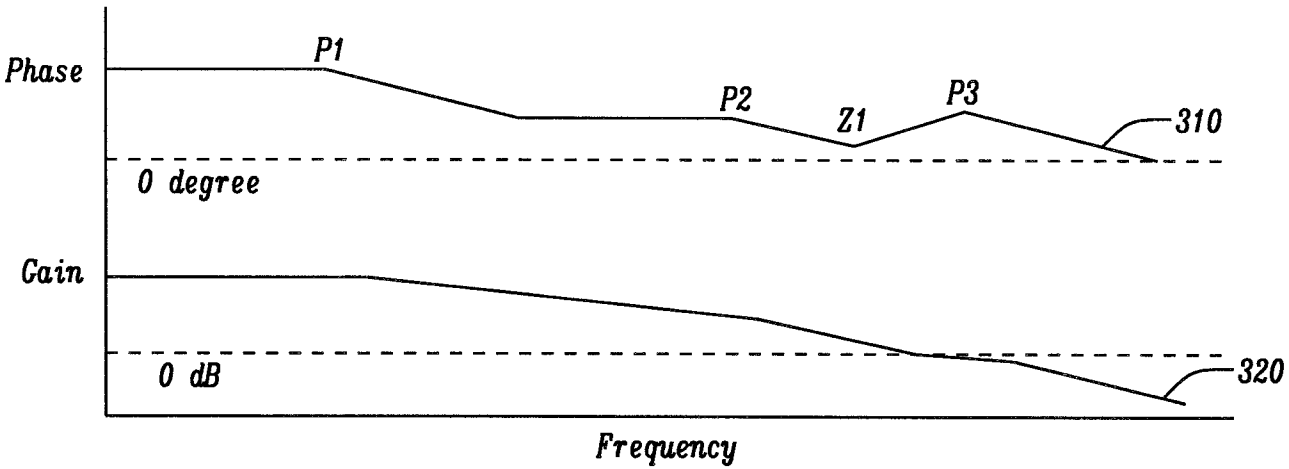
FIG. 3 is a Bode plot illustrating the working of the voltage regulator of FIG. 2.

FIG. 3 is a Bode plot of the circuit 200 of FIG. 2 obtained for a load resistance equal to infinity, hence corresponding to a no-load condition. The Bode plot shows a phase plot 310 expressing phase shift, and a gain plot 320 expressing the magnitude of the frequency response.

With reference to equations (2) and (4) above, it can be deduced that if the compensation capacitor Cc1 230 becomes very small, then P2 and Z1 will move to high frequencies. In this case, the pole P3 may fall below the unity gain frequency UGF indicating the maximum frequency for which a device can produce a useful gain. As a result, the phase margin is reduced. To prevent this scenario, the capacitor Cc1 must be sufficiently large. For instance, the capacitor Cc1 may be several times larger than the capacitor Cmp of the pass transistor 202. This increases the size of the circuit and slows down its response time.

Figure 4:
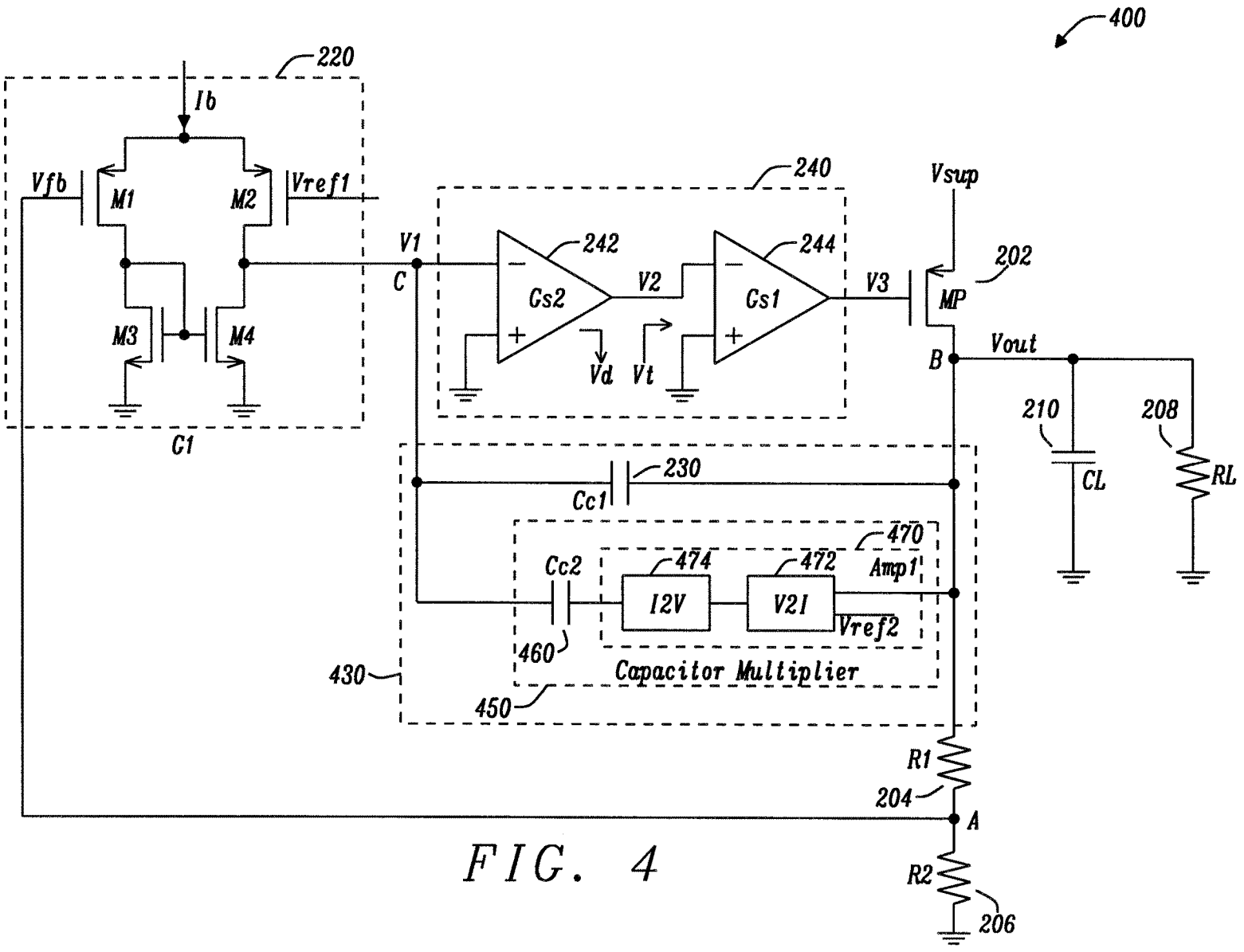
FIG. 4 is a linear voltage regulator provided with a capacitance multiplier.

FIG. 4 illustrates a voltage regulator provided a frequency compensation circuit that includes a capacitance multiplier. The circuit of FIG. 4 shares similar components to those illustrated in FIG. 2. The same reference numerals have been used to represent corresponding components and their description will not be repeated for the sake of brevity.

The circuit 400 includes a frequency compensation circuit 430 formed by the first compensation capacitor Cc1 230 coupled to a capacitance multiplier 450. In this example, the capacitor multiplier 450 is coupled in parallel with the capacitor Cc1 230. The capacitance multiplier 450 includes a second compensation capacitor Cc2 460 coupled to a voltage amplifier 470 having a gain greater than 1. The voltage amplifier 470 includes a voltage to current converter 472 coupled to a current to voltage converter 474.

The capacitor Cc2 460 has a first terminal coupled to node C and a second terminal coupled to the output of the voltage amplifier 470. The voltage to current circuit 472 has a first input coupled to the output voltage at node B and a second input for receiving a voltage reference Vref2 from a reference circuit that is not shown.

In operation, the voltage to current circuit 472 converts a difference voltage between Vout and Vref2 into a difference current I-diff. The difference voltage may correspond to a high frequency component of the output voltage associated with variations in the output voltage. The current I-diff is then provided to the current to voltage circuit 474 to provide an amplified voltage Vamp. Hence, the voltage amplifier 470 amplifies the output voltage variations also referred to as ripples, by a voltage amplification factor K. As a result, the circuit 400 has an equivalent compensation capacitance Cceq that can be defined as Cc1+K*Cc2. The voltage amplification factor K is stable over process, supply voltage and temperature (PVT) variations and can be easily controlled. For instance, K can be adjusted based on the stability requirement of the system regardless of the input voltage of the LDO regulation loop.

Compared with the circuit 200 of FIG. 2, the circuit 400 can be implemented with a compensation capacitor Cc1 having a relatively low capacitance. This results in a faster transient response combined with a shorter turning time and a faster dynamic voltage changing DVC.

In contrast with traditional nested Miller compensation NMC techniques, the capacitance multiplier 450 provides no DC gain to the signal. As a result, the proposed approach allows changing the amplification factor without affecting the DC gain.

Figure 5B:
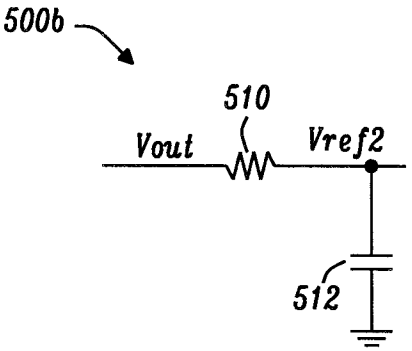
FIG. 5B is another reference voltage circuit.
Figure 5A:
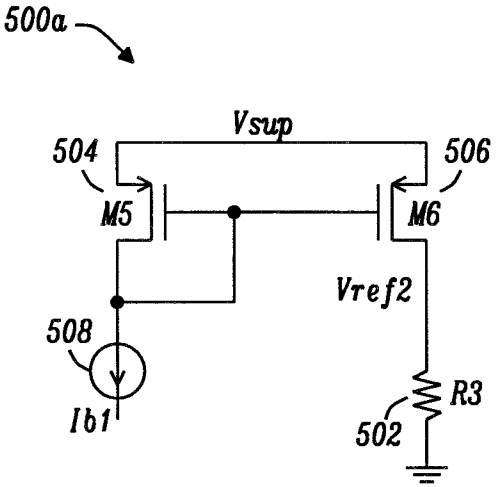
FIG. 5A is a reference voltage circuit.

FIGS. 5A and 5B illustrate two reference voltage circuits 500*a* and 500*b* for providing a reference voltage, such as Vref2 in FIG. 4. The reference circuit 500*a* includes a resistance R3 502 coupled to a current mirror provided by transistors M5 504 and M6 506. In operation, a current source 508 provides a constant current Ib1. The current Ib1 is injected into the resistance R3 via the current mirror, to generate a constant reference voltage Vref2=R3 Ib1. The reference circuit 500*b* is a low pass filter formed by a capacitor 512 coupled to a resistance 510. The low pass filter 500*b* has an input for receiving Vout, and an output for providing Vref2. The output voltage Vout may have a high frequency component and a low frequency component, such that Vref2 corresponds to the low frequency component.

Figure 6:
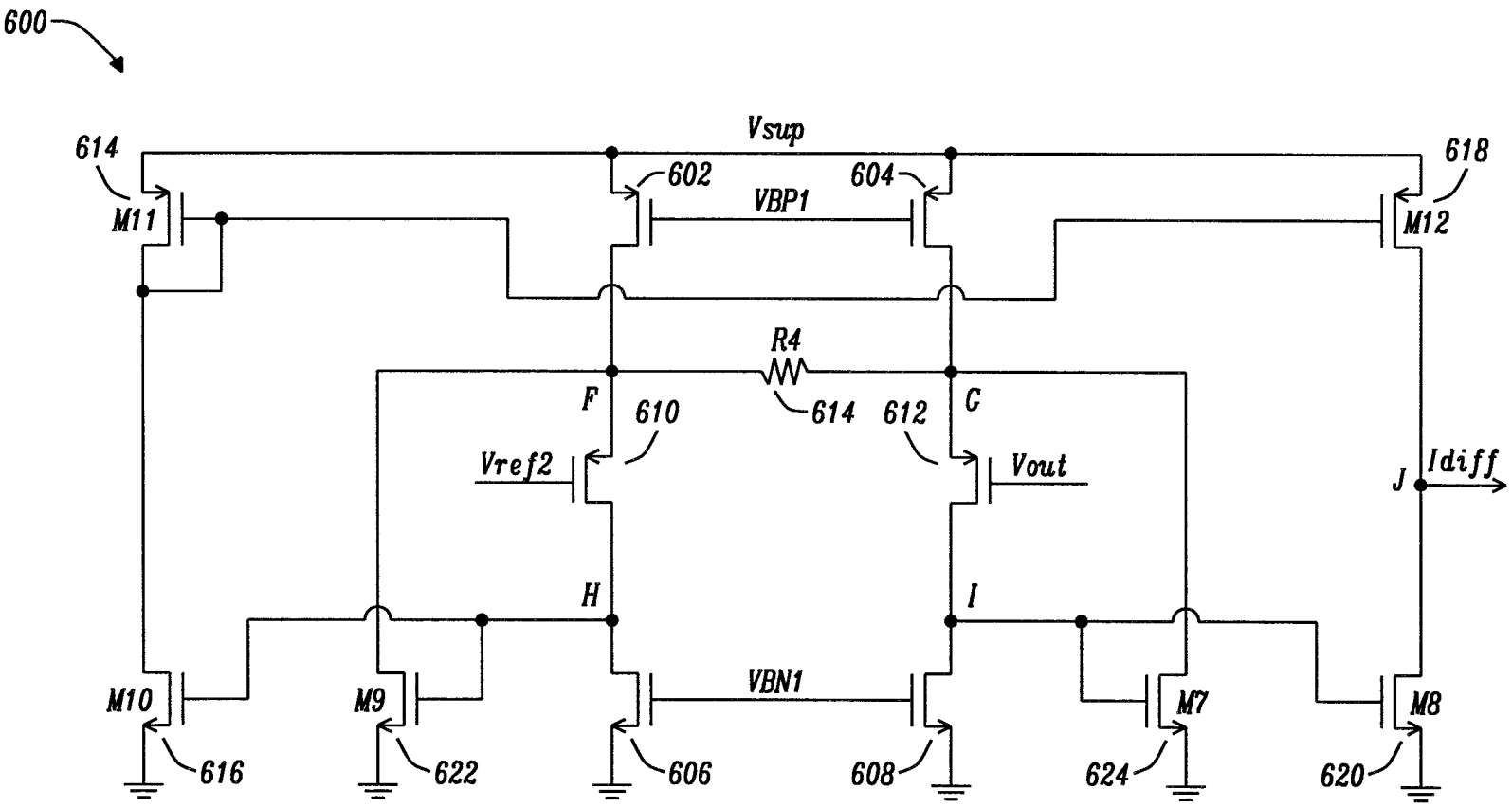
FIG. 6 is a voltage to current converter circuit.

FIG. 6 illustrates an exemplary voltage to current converter for use with the circuit of FIG. 4. The circuit 600 includes six pairs of transistors. A first pair is formed by transistor 602 and 604; a second pair is formed by transistors 606 and 608, a third pair is formed by transistors 614 and 618; a fourth pair is formed by transistors 616 and 622, a fifth pair is formed by transistors 624 and 620, and a sixth pair is formed by transistors 610 and 612. For each one of the first five pairs, the gate terminal of the first transistor is coupled to the gate terminal of the second transistor in the pair.

A first input transistor 610 has a gate terminal for receiving the voltage Vref2, a source terminal coupled to the drain terminal of transistor 602 at node F, and a drain terminal coupled to the drain terminal of transistor 606 at node H. A second input transistor 612 has a gate terminal for receiving the voltage Vout, a source terminal coupled to the drain terminal of transistor 604 at node G, and a drain terminal coupled to the drain terminal of transistor 608 at node I.

A resistor R4 614 is provided between the nodes F and G. The drain of transistor 622 of the fourth pair is coupled to the resistance R4 at node F. Similarly, the drain of transistor 624 is coupled to the resistance R4 at node G. The gate terminals of transistor 616 and 620 are coupled to nodes H and I respectively.

The source terminals of transistors 614, 618, 602 and 604 are coupled to each other and to a voltage supply providing a voltage Vsup. The third pair forms a current mirror. The drain of transistor M11 614 is coupled to its gate terminal and to the drain of transistor M10 616. Similarly, the drain of transistor M12 618 is coupled to the drain of transistor 620 at output node J.

The output of the circuit 600 provides a current I-diff defined as $$I_{-Diff} = \frac{2K1(Vout - Vref2)}{R_4} \quad (5)$$

in which K1 is the aspect ratio of transistors M8 620 to transistor M7 624.

The voltage supply Vsup should be greater than the output voltage Vout. If this is not the case, an additional level shifter may be provided at the input of the circuit such that the input voltage may be lowered.

Figure 7:
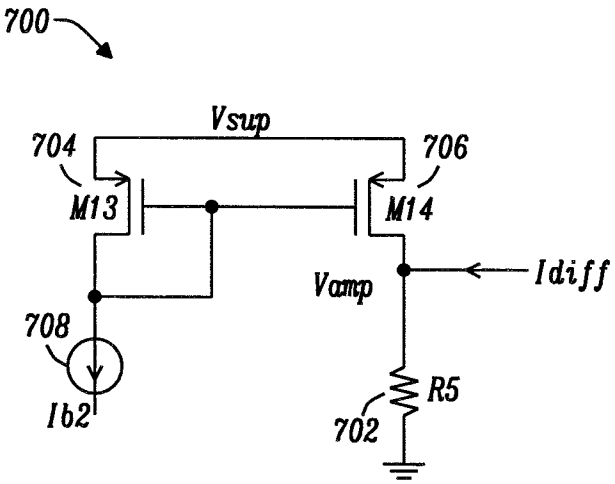
FIG. 7 is a current to voltage converter circuit.

FIG. 7 illustrates a current to voltage converter circuit. The circuit 700 includes a resistance R5 702 coupled to a current mirror provided by transistors M13 704 and M14 706. In operation, a current source 708 provides a constant current Ib2. The current Ib2 is injected into the resistance R5 via the current mirror to generate a DC voltage Vbase=R5*Ib2. In addition, a differential current I-diff is injected into the resistance R5 to generate a ripple voltage Vrip=R5*I-diff. The total voltage across R5 is the amplified voltage Vamp=Vbase+Vrip.

Referring back to FIG. 4, the capacitor Cc2 460 may be made of a metal insulator metal MIM capacitor stacked onto a metal oxide semiconductor MOS capacitor, for instance an N-type MOS capacitor having a gate terminal and a source terminal.

To achieve high capacitance, a NMOS capacitor should have gate to source voltage greater than its threshold voltage. The source terminal of Cc2 may be connected to the transistor M4 of the input stage 220 at node C and its gate terminal connected to the output of the current to voltage converter 474. The minimum voltage of Vamp provided at the output of the current to voltage converter 474 should be equal or close to Vgs(M4)+Vgs(Cc2) in which Vgs(M4) is the gate source voltage of transistor M4 228 and Vgs(Cc2) is the gate source voltage of the NMOS capacitor. The voltage Vbase provides a DC voltage that shifts the DC value of Vamp to the required value. For instance, if Vgs (M4)+Vgs(Cc2)=1.8V then Vbase provides a DC voltage of 1.8V.

When the voltage to current converter 472 and the current to voltage converter 474 are implemented by the circuits 600 and 700 respectively, the voltage amplification factor K of the voltage amplifier 470 is equal to:

$$K = \frac{2 * K1 * R_5}{R_4} \tag{6}$$

in which R4 and R5 are the resistances 614 and 702 provided in the circuits of FIGS. 6 and 7 respectively. The amplification factor K is stable over process, supply voltage, and temperature variations and may be controlled easily.

The capacitor multiplier 450 may be connected in different ways, for instance, the capacitor multiplier 450 may be connected anywhere in the resistive string R1, R2 of the potential divider. In the example of FIG. 4, the capacitor multiplier 450 has an input connected directly to the output Vout. This arrangement provides the fastest transient response. However, the circuit of FIG. 4 requires a separate circuit for the generation of Vref2. Also, if the voltage supply is close to Vout, for instance if it is within 50 mV, the reference voltage Vref2 may become noisy.

Figure 8:
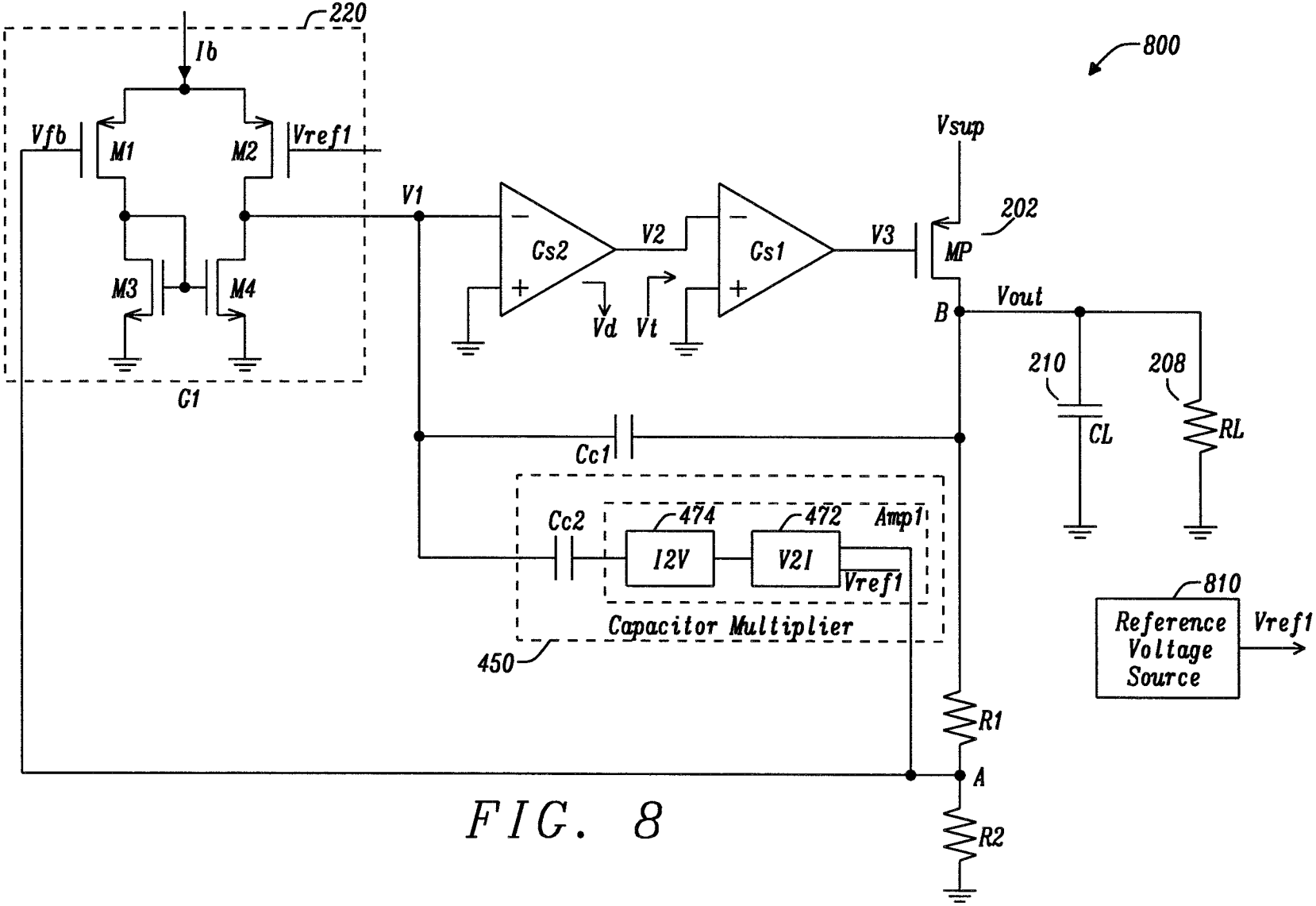
FIG. 8 is another linear voltage regulator provided with a capacitance multiplier.

FIG. 8 illustrates a modified version of the circuit 400 of FIG. 4. In this example, the input stage G1 220 and the capacitance multiplier 450 receive the same input Vref1 from a reference voltage source 810. The first input of the voltage to current converter is coupled to the output of the potential divider at node A and a second input of the voltage to current converter is coupled to the reference voltage source 810. There is therefore no need for an additional circuit providing another voltage reference. This reduces the size of the circuit.

Figure 9:
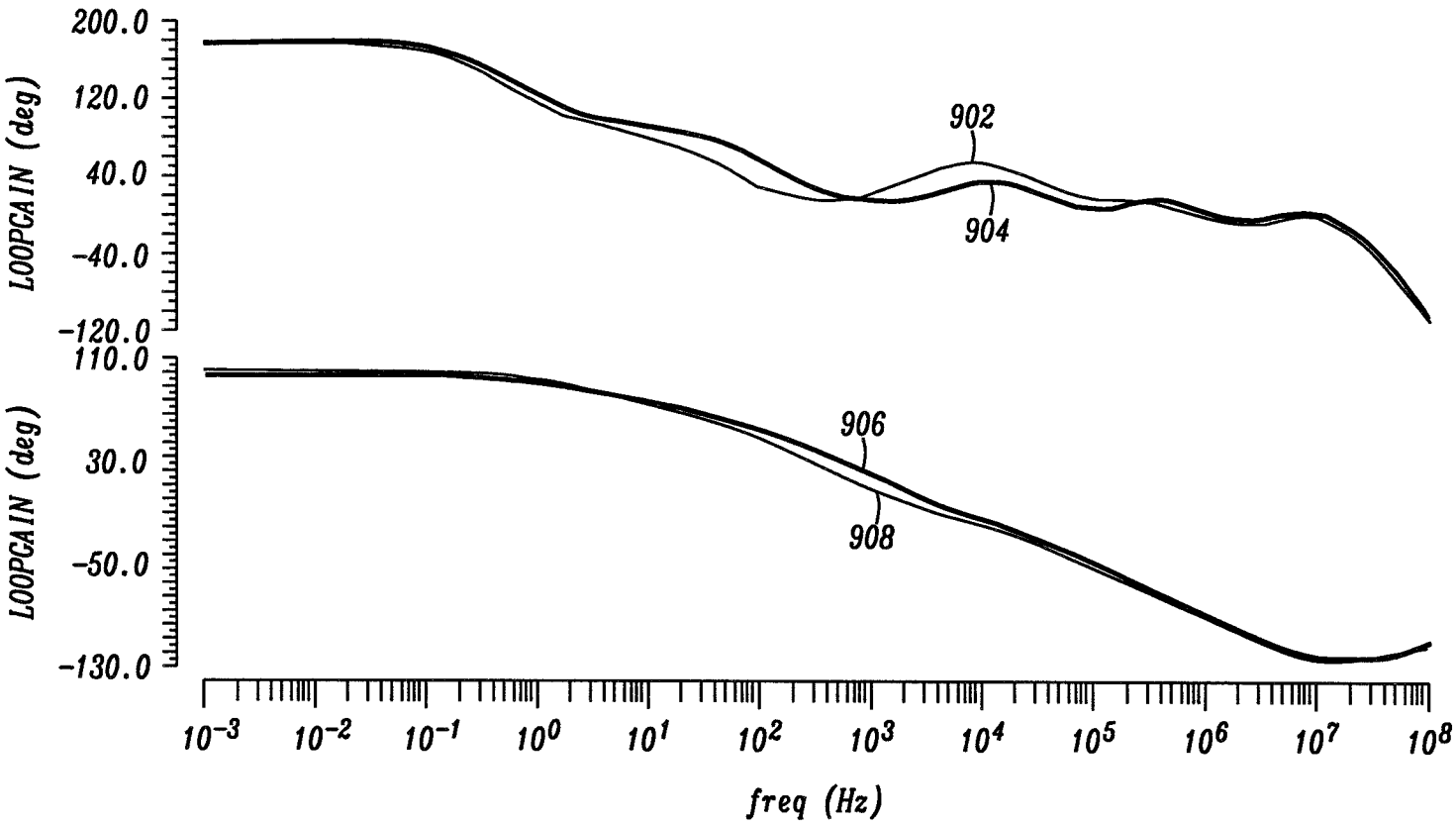
FIG. 9 is a simulation of a Bode plot provided for the circuits of FIGS. 2 and 8 respectively.

FIG. 9 illustrates a simulation of a Bode plot for the circuits 200 and 800 of FIGS. 2 and 8 respectively. The simulation is provided for a load current of 100 μA and includes the phase waveforms 902 and 904 of the circuit of FIGS. 2 and 8 respectively, as well as the gain waveforms 908 and 906 of the circuits of FIGS. 2 and 8 respectively.

Figure 10:
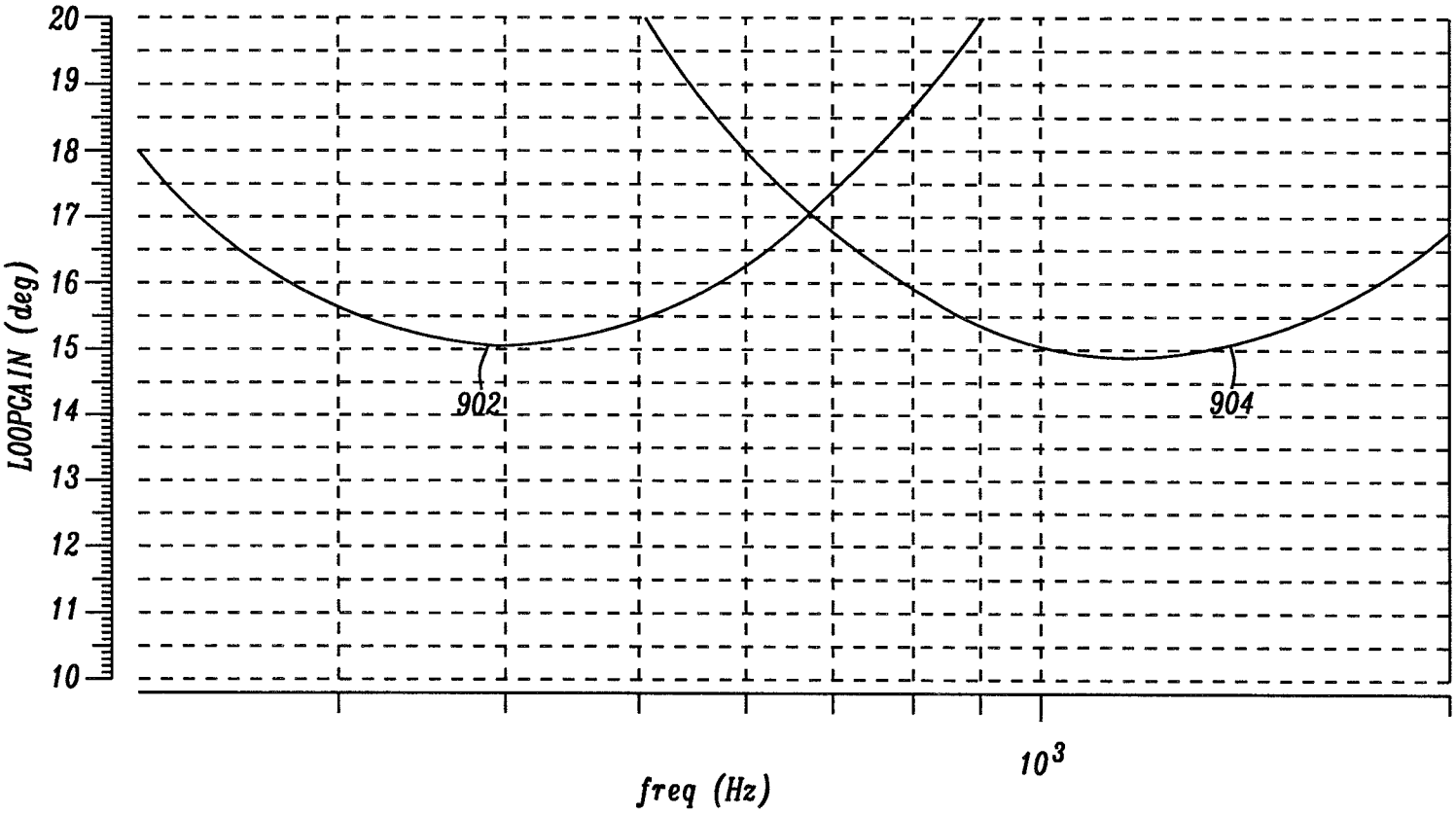
FIG. 10 is a close-up representation of FIG. 9 around 1 kHz.

FIG. 10 shows a close-up of the phase waveforms 902 and 904 around 1 kHz. The simulation is calculated for a physical capacitance in the circuit of FIG. 8 provided by Cc1+Cc2=33 pF, with an amplification factor K=8 and represented by waveform 904. The simulation of waveform 902 is calculated with a total physical capacitance Cc1=98 pF. The waveforms 902 and 904 display a similar behaviour in frequency; in other words, the minimum phase within the unity gain frequency has a similar value for both waveforms 902 and 904. However, the circuit of FIG. 8 only uses a total capacitance of 33 pF, hence 65 pF less than the total capacitance of the circuit of FIG. 2.

Figure 11:
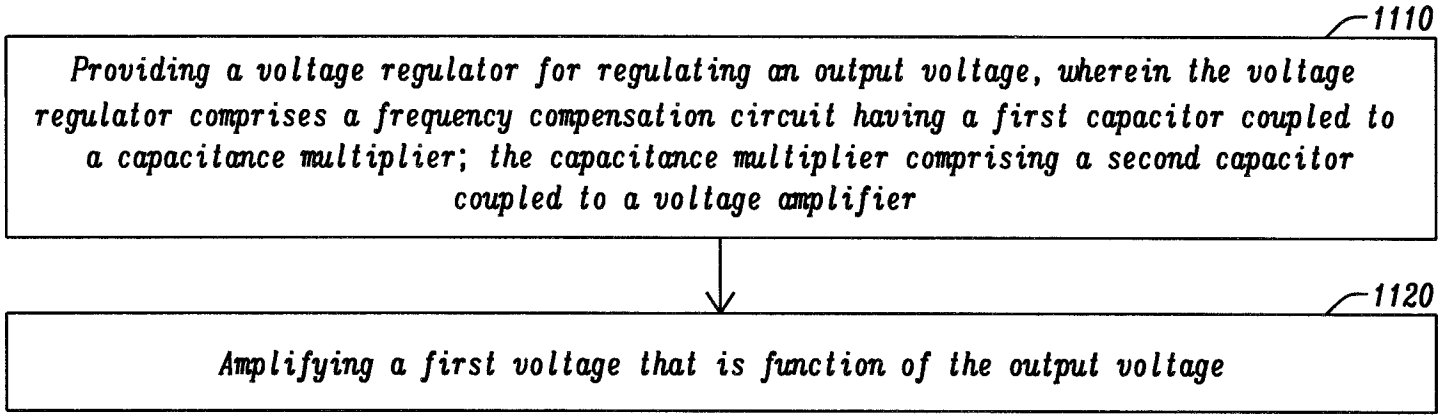
FIG. 11 is a flow chart of a method for regulating a voltage.

FIG. 11 is a flow chart of a method for regulating a voltage. At step 1110, a voltage regulator is provided for regulating an output voltage. The voltage regulator comprises a frequency compensation circuit having a first capacitor coupled to a capacitance multiplier. The capacitance multiplier comprises a second capacitor coupled to a voltage amplifier. At step 1120, a first voltage that is function of the output voltage is amplified using the voltage amplifier. For example, the first voltage may be a high frequency component of the output voltage associated with variations or ripples in the output voltage.

This approach allows increasing a total capacitance of the frequency compensation circuit, without unduly increasing the size of the regulator. It also allows changing the amplification factor without affecting the DC gain.

A skilled person will appreciate that variations of the disclosed arrangements are possible without departing from the disclosure. Accordingly, the above description of the specific embodiment is made by way of example only and not for the purposes of limitation. It will be clear to the skilled person that minor modifications may be made without significant changes to the operation described.

What is claimed is:

1. A voltage regulator for providing an output voltage at an output terminal via an output switch, the voltage regulator comprising an input stage coupled to a controller at an input node, the controller being adapted to control the output switch;

a frequency compensation circuit having a first capacitor coupled to a capacitance multiplier, the first capacitor having a first terminal coupled to the input node and a second terminal coupled to the output terminal;

wherein the capacitance multiplier comprises a second capacitor coupled to an output of a voltage amplifier configured to amplify a difference voltage that is function of the output voltage; wherein the voltage amplifier comprises a voltage-to-current converter coupled to a current-to-voltage converter; the voltage to current converter being adapted to receive a feedback voltage and a reference voltage and to provide a current to the current to voltage converter, the current being proportional to a difference between the feedback voltage and the reference voltage; wherein the second capacitor has a first terminal connected to the input node and a second terminal coupled to the output of the current-to-voltage converter.

2. The voltage regulator as claimed in claim 1, wherein the output voltage has a low frequency component and a high frequency component, and wherein the difference voltage corresponds to the high frequency component.

3. The voltage regulator as claimed in claim 1, wherein the first capacitor and the capacitance multiplier are coupled in parallel.

4. The voltage regulator as claimed in claim 1, wherein the output switch has a control terminal for receiving a control signal, and first and second path terminals located at a first and second end of a conductive path respectively; the output switch being adapted to selectively couple a voltage supply at the first end with an output of the regulator at the second end.

5. The voltage regulator as claimed in claim 4, wherein the voltage to current converter is coupled to the second path terminal.

6. The voltage regulator as claimed in claim 4, comprising a potential divider coupled to the second path terminal, wherein the voltage to current converter is coupled to an output of the potential divider.

7. The voltage regulator as claimed in claim 4, wherein the controller is adapted to provide the control signal; wherein the capacitance multiplier is coupled to an output of the input stage.

8. The voltage regulator as claimed in claim 1, comprising a reference voltage source coupled to the input stage and to the voltage to current converter.

9. The voltage regulator as claimed in claim 1, wherein the second capacitor comprises a metal-insulator-metal capacitor and a metal-oxide semiconductor capacitor.

10. The voltage regulator as claimed in claim 1, wherein the current to voltage converter is adapted to provide a voltage comprising a DC component.

11. The voltage regulator as claimed in claim 1, wherein the current to voltage converter comprises a constant current source coupled to a resistance via a current mirror.

12. The voltage regulator as claimed in claim 1, wherein the voltage regulator is a linear regulator.

13. A method of regulating a voltage comprising the steps of:

providing a voltage regulator for providing an output voltage at an output terminal via an output switch;

wherein the voltage regulator comprises an input stage coupled to a controller at an input node, the controller being adapted to control the output switch and a frequency compensation circuit having a first capacitor coupled to a capacitance multiplier, the first capacitor having a first terminal coupled to the input node and a second terminal coupled to the output terminal; the capacitance multiplier comprising a second capacitor coupled to an output of a voltage amplifier; and amplifying a difference voltage that is function of the output voltage wherein the voltage amplifier comprises a voltage-to-current converter coupled to a current-to-voltage converter; the voltage to current converter being adapted to receive a feedback voltage and a reference voltage and to provide a current to the current to voltage converter, the current being proportional to a difference between the feedback voltage and the reference voltage;

wherein the second capacitor has a first terminal connected to the input node and a second terminal coupled to the output of the current to voltage converter.

14. The method as claimed in claim 13, wherein the output voltage has a low frequency component and a high frequency component, and wherein the difference voltage corresponds to the high frequency component.

* * * * *